US007321253B2

(12) United States Patent
Hirabayashi et al.

(10) Patent No.: US 7,321,253 B2
(45) Date of Patent: Jan. 22, 2008

(54) MULTIPLIER

(75) Inventors: Atsushi Hirabayashi, Tokyo (JP); Kenji Komori, Kanagawa (JP)

(73) Assignee: Sony Corporation (JP)

( * ) Notice: Subject to any disclaimer, the term of this patent is extended or adjusted under 35 U.S.C. 154(b) by 25 days.

(21) Appl. No.: 10/499,867

(22) PCT Filed: Nov. 29, 2002

(86) PCT No.: PCT/JP02/12557

§ 371 (c)(1),
(2), (4) Date: Mar. 25, 2005

(87) PCT Pub. No.: WO03/056497

PCT Pub. Date: Jul. 10, 2003

(65) Prior Publication Data

US 2005/0173767 A1 Aug. 11, 2005

(30) Foreign Application Priority Data

Dec. 25, 2001 (JP) ..... 2001-391355

(51) Int. Cl.
*G06G 7/12* (2006.01)

(52) U.S. Cl. ..... 327/355; 327/356

(58) Field of Classification Search ..... 327/355, 327/356, 359, 361, 116, 119; 455/326, 333
See application file for complete search history.

(56) References Cited

U.S. PATENT DOCUMENTS 4,546,275 A 10/1985 Pena-Finol et al. ..... 327/357
5,355,534 A * 10/1994 Kimura ..... 455/323
5,396,659 A * 3/1995 Kimura ..... 455/333
5,606,738 A * 2/1997 Onodera et al. ..... 455/333
5,717,364 A * 2/1998 Ariie et al. ..... 332/135
5,872,446 A * 2/1999 Cranford et al. ..... 323/315
5,875,392 A * 2/1999 Tanaka ..... 455/321
5,909,136 A 6/1999 Kimura ..... 327/356
6,388,501 B2 * 5/2002 Chien ..... 327/355
6,466,775 B1 * 10/2002 Franca-Neto ..... 455/326
6,469,564 B1 * 10/2002 Jansen ..... 327/365
6,573,760 B1 * 6/2003 Gabara ..... 327/65

FOREIGN PATENT DOCUMENTS

JP 5-46792 A 2/1993
JP 8-50625 A 2/1996

* cited by examiner

*Primary Examiner*—Kenneth B. Wells
*Assistant Examiner*—Hai L. Nguyen
(74) *Attorney, Agent, or Firm*—Lerner, David, Littenberg, Krumholz & Mentlik, LLP

(57) ABSTRACT

A conventional multiplier which uses a MOS transistor has a subject that, in order to compensate for a variation of a bias voltage or the like, it is necessary to add a complicated correcting circuit to an outputting section or the like, and the circuit scale becomes great and the power consumption increases. A multiplier includes NMOS transistors (3, 4, 5) and constant voltage sources (6, 9, 12) connected to the gates of the NMOS transistors (3, 4, 5), respectively, and the voltage value of a constant voltage source (9) and the voltage value of another constant voltage source (12) are set equal to each other. Further, the NMOS transistor (4) and the NMOS transistor (5) are formed same as each other.

2 Claims, 7 Drawing Sheets

MULTIPLIER

TECHNICAL FIELD

This invention relates to a multiplier for use with a semiconductor integrated circuit and the like, and more particularly to a multiplier formed using a MOS transistor.

BACKGROUND ART

FIG. 1 is a circuit diagram showing an example of a conventional multiplier which uses a MOS transistor and is known as Gilbert Mixer. The Gilbert Mixer has a characteristic that it has a great input dynamic range and a great output dynamic range. Referring to FIG. 1, reference numeral 101 denotes a voltage source, 102 a ground, 103 a first differential signal source, and 104 a second differential signal source. Further, reference numerals 105 and 106 denote each an NMOS transistor connected at the gate thereof to the first differential signal source 103, 107 and 108 denote each an NMOS transistor connected at the source thereof to the drain of the NMOS transistor 105 and at the gate thereof to the second differential signal source 104, and 109 and 110 denote each an NMOS transistor connected at the source thereof to the drain of the NMOS transistor 106 and at the gate thereof to the second differential signal source 104. Reference numeral 111 denotes a PMOS transistor connected at the drain and the gate thereof to the drain of the NMOS transistor 107 and the drain of the NMOS transistor 109, respectively, 112 a PMOS transistor connected at the gate thereof to the drain of the NMOS transistor 107 and the drain of the NMOS transistor 109, and 113 a PMOS transistor connected at the drain and the gat thereof to the drain of the NMOS transistor 108 and the drain of the NMOS transistor 110, respectively. Reference numeral 114 denotes a PMOS transistor connected at the gate thereof to the drain of the NMOS transistor 108 and the drain of the NMOS transistor 110, 115 an NMOS transistor connected at the drain thereof to the drain of the PMOS transistor 112, and 116 an NMOS transistor connected at the drain and the gate thereof to the drain of the PMOS transistor 114. Further, reference numeral 117 denotes a load resistor connected to a node between the drain of the PMOS transistor 112 and the NMOS transistor 115, and 118 a biasing voltage source.

A V-I conversion section for converting a signal voltage outputted from the first differential signal source 103 into signal current is formed from the NMOS transistor 105 and the NMOS transistor 106. A first switching section for performing switching based on a signal voltage outputted from the second differential signal source 104 is formed from the NMOS transistor 107 and the NMOS transistor 108. A second switching section for performing switching based on a signal voltage outputted from the second differential signal source 104 is formed from the NMOS transistor 109 and the NMOS transistor 110. A current mirror for turning back current obtained as the sum of drain current of the NMOS transistor 107 and drain current of the NMOS transistor 109 is formed from the PMOS transistor 111 and the PMOS transistor 112. Another current mirror for turning back current obtained as the sum of drain current of the NMOS transistor 108 and drain current of the NMOS transistor 110 is formed from the PMOS transistor 113 and the PMOS transistor 114. A further current mirror for turning back drain current of the PMOS transistor 114 is formed from the NMOS transistor 115 and the NMOS transistor 116.

Now, operation is described. The V-I conversion section converts a voltage signal applied thereto from the first differential signal source 103 and given as a first signal into a current signal. The first switching section and the second switching section switch signal current converted by the V-I conversion section based on a voltage signal applied thereto from the second differential signal source 104 and given as a second signal to obtain a multiplication output obtained in the form of a current output.

Each of the three current mirrors turns back the same output current by converting respective output current into a gate-source voltage of a MOS transistor and sharing the gate-source voltage by a MOS transistor of the same channel paired with the MOS transistor. Accordingly, by taking out difference current between signal current according to multiplication outputs and inverted signal current according to the multiplication outputs using the three current mirrors and converting the difference current into voltages by means of the load register 117, a multiplication output can be obtained in the form of a voltage output. In other words, in the Gilbert Mixer, the three current mirrors function as current-voltage converters.

Since the Gilbert Mixer given as a conventional multiplier is configured in such a manner as described above, it has a node between a PMOS transistor and an NMOS transistor, and mismatching in characteristic between the MOS transistors gives rise to a variation of a bias voltage or the like, which makes the circuit operation unstable. In order to compensate for such a variation of a bias voltage or the like described above, it is necessary to add a complicated correcting circuit to an outputting section or the like. Therefore, the Gilbert Mixer has a subject that the circuit scale becomes great and the power consumption increases. Further, since a current mirror is used in order to carry out current-voltage conversion, there is a subject that the frequency characteristic is degraded.

DISCLOSURE OF INVENTION

The present invention has been made to solve such subjects as described above, and it is an object of the present invention to provide a multiplier which can stabilize a circuit operation and reduce the power consumption even with a simple configuration.

It is another object of the present invention to provide a multiplier which has a good frequency characteristic.

According to an aspect of the present invention, a multiplier is configured such that the multiplier comprises a first MOS transistor and a second MOS transistor and a third MOS transistor each having a drain connected to the source of the first MOS transistor, and first, second and third voltage sources connected to gates of the first, second and third MOS transistors, respectively, and that the second MOS transistor and the third MOS transistor are formed in such a manner as to have drain current coefficients substantially equal to each other and the second voltage source and the third voltage source have voltage values substantially equal to each other while all of the first to third MOS transistors are given as MOS transistors of the same type.

Where such a configuration as described above, when differential signals are inputted to the gates of the second MOS transistor and the third MOS transistor, the multiplier operates as a multiplier, and there is an effect that the circuit operation can be stabilized and the power consumption can be reduced even by the simple configuration. Further, since a current mirror or the like need not be additionally provided to obtain a voltage output, an effect is exhibited that a good frequency characteristic can be obtained.

Further, according to the present invention, the multiplier having the configuration described above is configured such that the first MOS transistor is formed in such a manner as to have a drain current coefficient substantially equal to twice a drain current coefficient of the second MOS transistor and the third MOS transistor, and a voltage difference between the voltage value of the first voltage source and the voltage value of the second voltage source and the third voltage source is substantially equal to one half a power supply voltage value.

Where such a configuration as described above is employed, the bias voltage at the outputting section can be set to a voltage value equal to substantially one half the power supply voltage, and an effect that a large dynamic range can be obtained is exhibited.

According to another aspect of the present invention, a multiplier is configured such that the multiplier comprises a first MOS transistor, a second MOS transistor and a third MOS transistor each having a drain connected to a source of the first MOS transistor, a fourth MOS transistor, a fifth MOS transistor and a sixth MOS transistor each having a drain connected to a source of the fourth MOS transistor, a seventh MOS transistor having a gate connected to the source of the first MOS transistor, and an eighth MOS transistor having a drain connected to a source of the seventh MOS transistor and a gate connected to the source of the fourth MOS transistor, and first, second, third, fourth, fifth and sixth voltage sources connected to gates of the first, second, third, fourth, fifth and sixth MOS transistors, that voltage values of the second, third, fifth and sixth voltage sources are substantially equal to one another, that the second and third MOS transistors are formed in such a manner as to have drain current coefficients substantially equal to each other and the fifth and sixth MOS transistors are formed in such a manner as to have drain current coefficients substantially equal to each other while the seventh and eighth MOS transistors have drain current coefficients substantially equal to each other, and that all of the first to eighth MOS transistors are given either as MOS transistors of the same type.

Where such a configuration as described above is employed, when first differential signals are inputted to the gates of the second MOS transistor and the third MOS transistor and second differential signals are inputted to the gates of the fifth MOS transistor and the sixth MOS transistor, the multiplier operates as a multiplier and exhibits an effect that the circuit operation can be stabilized and the power consumption can be reduced even with a simple configuration. Further, the multiplier exhibits another effect that a DC offset which arises from AC components can be reduced by the outputting section of the multiplier. Furthermore, since there is no necessity to add a current mirror or the like in order to obtain a voltage output, the multiplier exhibits an effect that a good frequency characteristic can be obtained.

Further, according to the present invention, the multiplier having the configuration described above is configured such that the first MOS transistor is formed in such a manner as to have the drain current coefficient substantially equal to twice the drain current coefficient of the second and third MOS transistors while the fourth MOS transistor is formed in such a manner as to have the drain current coefficient substantially equal to twice the drain current coefficient of the fifth and sixth MOS transistors, and a voltage difference between the voltage value of the first voltage source and the voltage value of the fourth voltage source is substantially equal to one half a power supply voltage value.

Where such a configuration as described above is employed, the bias voltage at the outputting section can be set to a voltage value equal to substantially one half the power supply voltage, and an effect that a large dynamic range can be obtained is exhibited.

According to a further aspect of the present invention, a multiplier is configured such that the multiplier comprises a first MOS transistor, a second MOS transistor having a drain connected to a source of the first MOS transistor, third and fourth MOS transistors each having a drain connected to a source of the second MOS transistor, a fifth MOS transistor, a sixth MOS transistor having a drain connected to a source of the fifth MOS transistor, seventh and eights MOS transistors each having a drain connected to a source of the sixth MOS transistor, a ninth MOS transistor having a gate connected to the source of the first MOS transistor, a tenth MOS transistor having a drain connected to a source of the ninth MOS transistor and a gate connected to the source of the sixth MOS transistor, an eleventh MOS transistor having a gate connected to the source of the fifth MOS transistor, and a twelfth MOS transistor having a drain connected to a source of the eleventh MOS transistor and a gate connected to the source of the second MOS transistor, and first, second, third, fourth, fifth, sixth, seventh and eighth voltage sources connected to gates of the first, second, third, fourth, fifth, sixth, seventh and eighth MOS transistors, that voltage values of the third, fourth, seventh and eighth voltage sources are substantially equal to one another, that the third and fourth MOS transistors are formed in such a manner as to have drain current coefficients substantially equal to each other and the seventh and eighth MOS transistors are formed in such a manner as to have drain current coefficients substantially equal to each other while the ninth and tenth MOS transistors have drain current coefficients substantially equal to each other and the eleventh and twelfth MOS transistors have drain current coefficients substantially equal to each other, and that all of the first to twelfth MOS transistors are given either as MOS transistors of the same type.

Where such a configuration as described above is employed, when first differential signals are inputted to the gates of the third MOS transistor and the fourth MOS transistor and second differential signals are inputted to the gates of the seventh MOS transistor and the eighth MOS transistor, the multiplier operates as a multiplier and exhibits an effect that the circuit operation can be stabilized and the power consumption can be reduced even with a simple configuration. Further, the multiplier exhibits another effect that an output of the multiplier can be obtained as differential signals and a DC offset which arises from AC components can be removed by the outputting section of the multiplier. Furthermore, since there is no necessity to add a current mirror or the like in order to obtain a voltage output, the multiplier exhibits an effect that a good frequency characteristic can be obtained.

Further, according to the present invention, the multiplier having the configuration described above is configured such that the first and second MOS transistors are formed in such a manner as to have the drain current coefficient substantially equal to twice the drain current coefficient of the third and fourth MOS transistors while the fifth and sixth MOS transistors are formed in such a manner as to have the drain current coefficient substantially equal to twice the drain current coefficient of the seventh and eighth MOS transistors, and that voltage values of the first and fifth voltage sources are substantially equal to each other while voltage values of the second and sixth voltage sources are substantially equal to each other, and a voltage difference between the voltage value of the first and fifth voltage sources and the voltage value of the second and sixth voltage sources is substantially equal to one half a power supply voltage value.

Where such a configuration as described above is employed, the bias voltage at the outputting section can be set to a voltage value equal to substantially one half the power supply voltage, and an effect that a large dynamic range can be obtained is exhibited.

BEST MODE FOR CARRYING OUT THE INVENTION

In the following, embodiments according to the invention of the present application are described with reference to the accompanying drawings. It is to be noted that, in the following description, in order to clarify a corresponding relationship between various elements described in the description of the embodiments of the invention of the present application and forming the embodiments and various elements which form the invention described in the claims, the elements of the invention described in the claims and corresponding to the elements described in the description of the embodiments are represented suitably in parentheses.

Embodiment 1

Figure 1:
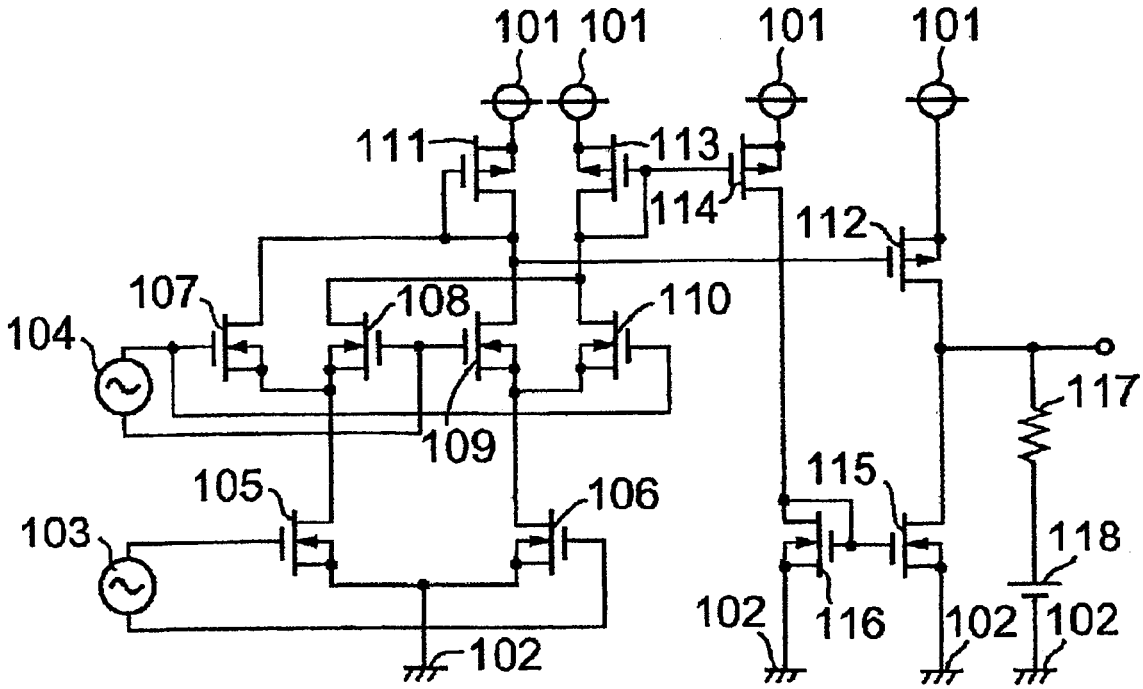
Fig.1 PRIOR ART
FIG. 1 is a circuit diagram showing an example of a conventional multiplier which uses a MOS transistor.
Figure 2:
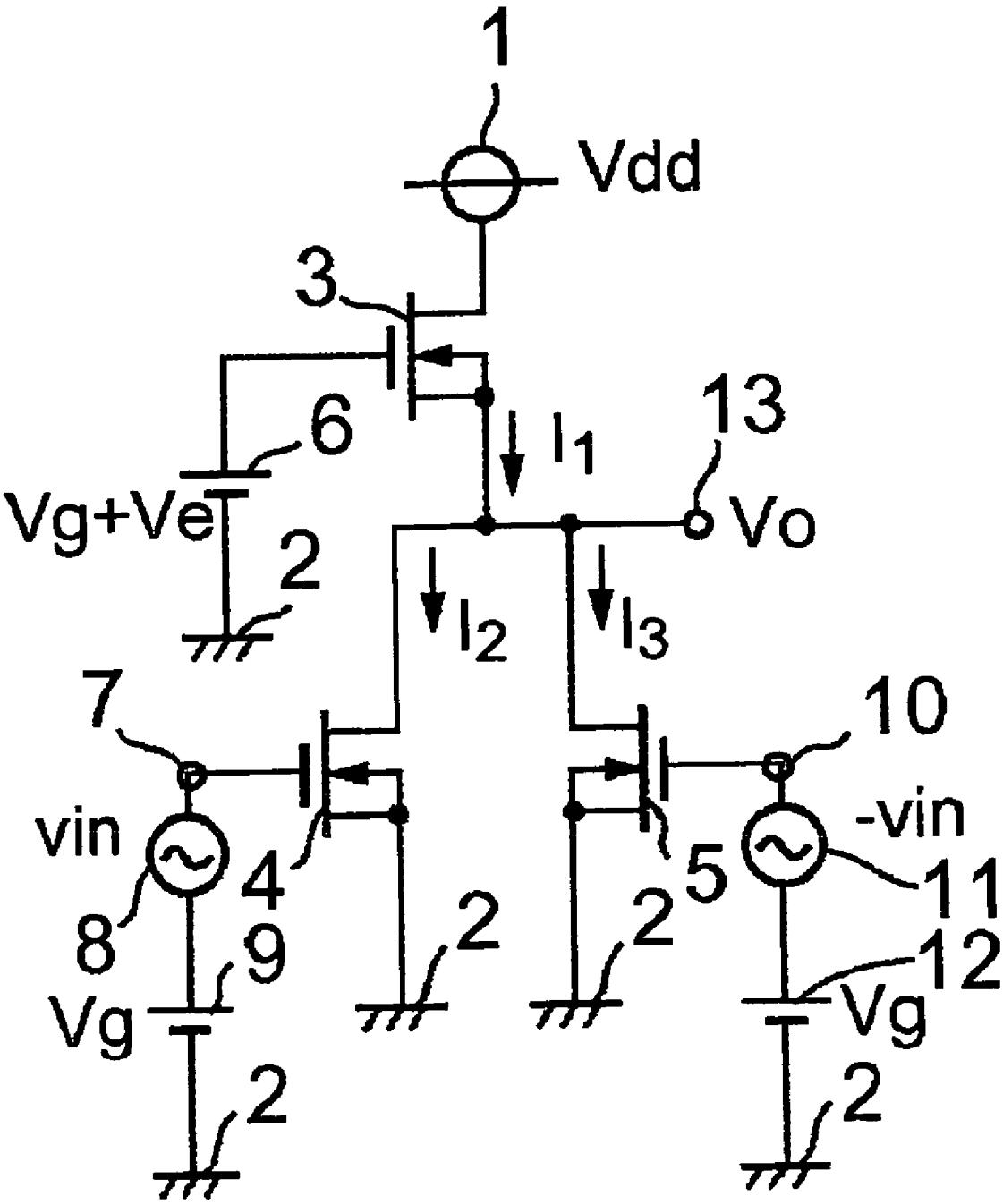
FIG. 2 is a circuit diagram showing a configuration of a multiplier according an embodiment 1 of the present invention.

FIG. 2 is a circuit diagram showing a configuration of a multiplier according to an embodiment 1 of the present invention. Referring to FIG. 2, reference numeral 1 denotes a voltage source, 2 a ground, 3 an NMOS transistor (first NMOS transistor) connected at the drain thereof to the voltage source 1, 4 an NMOS transistor (second NMOS transistor) connected at the drain thereof to the source of the NMOS transistor 3 and at the source thereof to the ground 2, and 5 an NMOS transistor (third MOS transistor) connected at the drain thereof to the source of the NMOS transistor 3 and at the source thereof to the ground 2. Reference numeral 6 denotes a constant voltage source (first voltage source) connected to the gate of the NMOS transistor 3, 7 a first input terminal connected to the gate of the NMOS transistor 4, and 8 a first differential signal source for applying an input signal vin which forms differential signals to the first input terminal 7. Reference numeral 9 denotes a constant voltage source (second voltage source) for applying a predetermined voltage to the first input terminal 7, 10 a second input terminal connected to the gate of the NMOS transistor 5, and 11 a second differential signal source for applying the other input signal −vin which forms the differential signals to the second input terminal 10. Reference numeral 12 denotes a constant voltage source (third voltage source) for applying a predetermined voltage to the second input terminal 10, and 13 an output terminal connected to a node between the source of the NMOS transistor 3 and the drains of the NMOS transistor 4 and the NMOS transistor 5. It is to be noted that the back gate of each of the NMOS transistors 3, 4 and 5 used in the multiplier shown in FIG. 2 is connected to the source of the NMOS transistor in order to make the mutual conductance equal among them. Meanwhile, the voltage sources 6, 9 and 12 given as biasing voltage sources can be implemented by various methods such as, for example, a method of dividing the power supply voltage of the voltage source 1 by means of resistors.

Now, operation is described. Referring to FIG. 2, the drain current coefficient of the NMOS transistor 3 is represented by M1, and the drain current coefficients of the NMOS transistor 4 and the NMOS transistor 5 are represented by M2 under the assumption that they are formed same as each other. Further, the drain current of the NMOS transistor 3 is represented by I1, the drain current of the NMOS transistor 4 by I2, and the drain current of the NMOS transistor 5 by I3. Further, the power supply voltage value of the voltage source 1 is represented by Vdd, the voltage value of the constant voltage source 6 by Vg', the voltage values of the constant voltage source 9 and the constant voltage source 12 are represented by Vg under the assumption that they are formed same as each other, and the voltage value of the output terminal 13 is represented by Vo. Further, the difference between the voltage value of the constant voltage source 6 and the voltage value of the constant voltage source 9 is represented by Ve, that is, Vg'=Vg+Ve.

If it is assumed that the output terminal 13 is open or is in a state close to an open state, then the drain currents I1, I2 and I3 satisfy I1=I2+I3. The drain current I1 is given by an expression (1), the drain current I2 by another expression (2), and the drain current I3 by a further expression (3). Further, if the expression (1), the expression (2) and the expression (3) are substituted into I1=I2+I3, then an expression (4) is obtained. It is to be noted that, in the expression above, Vth represents a threshold voltage of the MOS transistors.

$$I_1 = \frac{M_1}{2}(Ve + Vg - Vo - Vth)^2 \tag{1}$$

$$I_2 = \frac{M_2}{2}(Vg + vin - Vth)^2 \tag{2}$$

$$I_3 = \frac{M_2}{2}(Vg - vin - Vth)^2 \tag{3}$$

$$\begin{aligned}\frac{M_1}{2}\cdot(Ve + Vg - Vo - Vth)^2 &= \frac{M_2}{2}\cdot(Vg + vin - Vth)^2 + \frac{M_2}{2}\cdot \\ &\quad (Vg - vin - Vth)^2 \\ &= M_2(Vg - Vth)^2 + M_2\cdot vin^2\end{aligned} \tag{4}$$

Here, if it is assumed that the drain current coefficient M1 of the NMOS transistor 3 and the drain current coefficient M2 of the NMOS transistor 4 and the NMOS transistor 5 is represented using α as indicated by an expression (5), then an expression (6) can be introduced from the expression (4). Further, an expression (7) can be introduced by factorizing the expression (6) based on $a^2-b^2=(a+b)(a-b)$ and taking the voltage values into consideration. Further, the expression (8) is obtained by differentiating the expression (7) with respect to the output voltage Vo. Since, in the expression (8), the expression in √ can be differentiated any number of times with respect to the input signal vin which is a variable, the expression (8) can be transformed like an expression (9) using the Taylor expansion.

$$\alpha^2 = \frac{2M_2}{M_1}(\alpha > 0) \tag{5}$$

$$(Ve+Vg-Vo-Vth)^2-\alpha^2\cdot\{(Vg-Vth)^2+vin^2\}=0 \tag{6}$$

$$Ve+Vg-Vo-Vth-\alpha\cdot\sqrt{(Vg-Vth)^2+vin^2}=0 \tag{7}$$

$$\begin{aligned} Vo &= Ve + Vg - Vth - \alpha\cdot\sqrt{(Vg-Vth)^2+vin^2} \\ &= Ve + Vg - Vth - \alpha(Vg-Vth)\sqrt{1+\frac{vin^2}{(Vg-Vth)^2}} \end{aligned} \tag{8}$$

$$Vo = Ve + Vg - Vth - \alpha\cdot(Vg-Vth)\left\{1+\frac{vin^2}{21\cdot(Vg-Vth)^2}+\ldots\right\} \tag{9}$$

Here, if the NMOS transistor 3, NMOS transistor 4 and NMOS transistor 5 are formed such that α=1, that is, M1=2M2, is satisfied, then the output voltage Vo is given as represented by an expression (10). As can be seen clearly from the expression (10), the voltage at the output terminal 13 is equal to the voltage difference Ve between the constant voltage source 6 and the constant voltage sources 9 and 12. Accordingly, if the voltage difference Ve is set equal to one half the power supply voltage value Vdd, then the bias voltage at the outputting section of the multiplier can be made equal to Vdd/2, and the greatest dynamic range can be obtained.

$$Vo \approx Ve - \frac{vin^2}{2(Vg-Vth)} \tag{10}$$

As indicated by the expression (10), it can be recognized that a voltage signal which increases in proportion to the square of the input signal vin can be obtained at the outputting section of the multiplier shown in FIG. 2. Here, if it is assumed that the input signal is given as the sum of two signals having different phases from each other and the input signal vin is represented by an expression (11), then $vin^2$ is given as represented by an expression (12). If it is assumed that an LPF is used to remove high frequency band components of an output signal, then $vin^2$ is given as represented by an expression (13). The first term of the expression (13) indicates a DC offset which arises from an AC component in response to the levels of the two signals which form the input signal vin, and the second term indicates phase detection of the two signals which form the input signal vin.

$$vin = A\cdot\sin(\omega t) + B\cdot\sin(\omega t+\theta) \tag{11}$$

$$\begin{aligned} vin^2 &= A^2\cdot\sin^2\omega t + 2AB\sin\omega t\cdot\sin(\omega t+\theta) + B^2\cdot\sin^2(\omega t+\theta) \\ &= \frac{A^2}{2}\cdot(1-\cos 2\omega t) + \frac{B^2}{2}\cdot[1-\cos(2\omega t+2\theta)] \\ &\quad + AB\cos\theta\cdot(1-\cos 2\omega t) + AB\sin\theta\cdot\sin 2\omega t \end{aligned} \tag{12}$$

$$vin^2 = \frac{A^2+B^2}{2} + AB\cos\theta \tag{13}$$

On the other hand, if the input signal is given as the sum of two signals having different frequencies and the input signal vin is represented as indicated by an expression (14), then $vin^2$ is given as represented by an expression (15). If it is assumed that an LPF is used to remove high frequency band components of an output signal, then $vin^2$ is given as represented by an expression (16). The first term of the expression (16) indicates a DC offset which arises from AC components in response to the levels of the two signals which form the input signal vin, and the second term indicates frequency conversion regarding the two signals which form the input signal vin.

$$vin = A\sin\omega_1 t + B\sin\omega_2 t \tag{14}$$

$$\begin{aligned} vin^2 &= A^2\cdot\sin^2\omega_1 t + 2AB\sin\omega_1 t\cdot\sin\omega_2 t + B^2\cdot\sin^2\omega_2 t \\ &= \frac{A^2}{2}\cdot(1-\cos 2\omega_1 t) + \frac{B^2}{2}\cdot[1-\cos 2\omega_2 t] \\ &\quad + AB\cos(\omega_1-\omega_2)t - AB\cos(\omega_1+\omega_2)t \end{aligned} \tag{15}$$

$$vin^2 = \frac{A^2+B^2}{2} + AB\cos(\omega_1-\omega_2)t \tag{16}$$

As seen from the foregoing, it is indicated by the expression (10) that an output signal which increases in proportion to $vin^2$ is obtained in accordance with the input signal vin and a characteristic that phase detection of the two signals which form the input signal can be performed is indicated by the expression (13). Further, another characteristic that frequency conversion of the two signals which form the input signal is indicated by the expression (16). Consequently, it can be recognized that the circuit shown in FIG. 2 has a function as a mixer.

Incidentally, it is known that parameters regarding device characteristics of transistors disperse by a great amount arising from delicate differences in production environments which normally arise in various production processes (in the following description, such dispersion in device characteristic of a transistor which arises in various production processes as just described is referred to as production dispersion). However, a plurality of NMOS transistors or a plurality of PMOS transistors formed on the same chip exhibit the same tendency in dispersion in characteristic. In the multiplier according to the embodiment 1 of the present invention, since all of the MOS transistors used have a single channel configuration given as NMOS transistors, errors arising from the production dispersions cancel each other to suppress variations in bias voltage and AC components to stabilize the circuit operation.

As described above, according to the present embodiment 1, the multiplier includes an NMOS transistor 3, another NMOS transistor 4 and a further NMOS transistor 5, and a constant voltage source 6, another constant voltage source 9 and a further constant voltage source 12, and the NMOS transistor 4 and the NMOS transistor 5 are formed same as each other while the voltage value of the constant voltage source 9 and the voltage value of the constant voltage source 12 are equal to each other and all of the MOS transistors used are given as NMOS transistor. Consequently, when differential signals are inputted to the gates of the NMOS transistor 4 and the NMOS transistor 5, the multiplier operates as a multiplier, and there is an effect that the circuit operation can be stabilized and the power consumption can be reduced even by the simple configuration. Further, according to the embodiment 1, an effect is exhibited that a good frequency characteristic can be obtained since a current mirror or the like need not be additionally provided to obtain a voltage output. It is to be noted that, while, in the present embodiment 1, the NMOS transistor 4 and the NMOS transistor 5 are formed same as each other, as clearly recognized from the expression (4) and so forth, a multiplier which exhibits the effects described above can be obtained by forming the NMOS transistor 4 and the NMOS transistor 5 such that they have an equal drain current coefficient. Further, where $\alpha \neq 1$, it is difficult to set the bias voltage at the output terminal 13 to the voltage difference between the voltage value of the constant voltage source 6 and the voltage value of the constant voltage source 9 and the constant voltage source 12. However, similarly as in the embodiment 1 described above, the output voltage can be obtained as the sum of the DC voltage and a voltage which increases in proportion to $vin^2$. Accordingly, also where $\alpha \neq 1$, the circuit shown in FIG. 2 can operate as a mixer, and similar effects can be exhibited.

Further, the NMOS transistor 3, NMOS transistor 4 and NMOS transistor 5 are formed such that the drain current coefficient M1 of the NMOS transistor 3 is equal to twice the drain current coefficient M2 of the NMOS transistor 4 and the NMOS transistor 5, and the voltage difference between the voltage value of the constant voltage source 6 and the voltage value of the constant voltage source 9 and the constant voltage source 12 is equal to Vdd/2 which is a voltage value equal to one half the power supply voltage value. Therefore, the bias voltage at the outputting section can be set to Vdd/2, and an effect that a large dynamic range can be obtained is exhibited.

Figure 3:
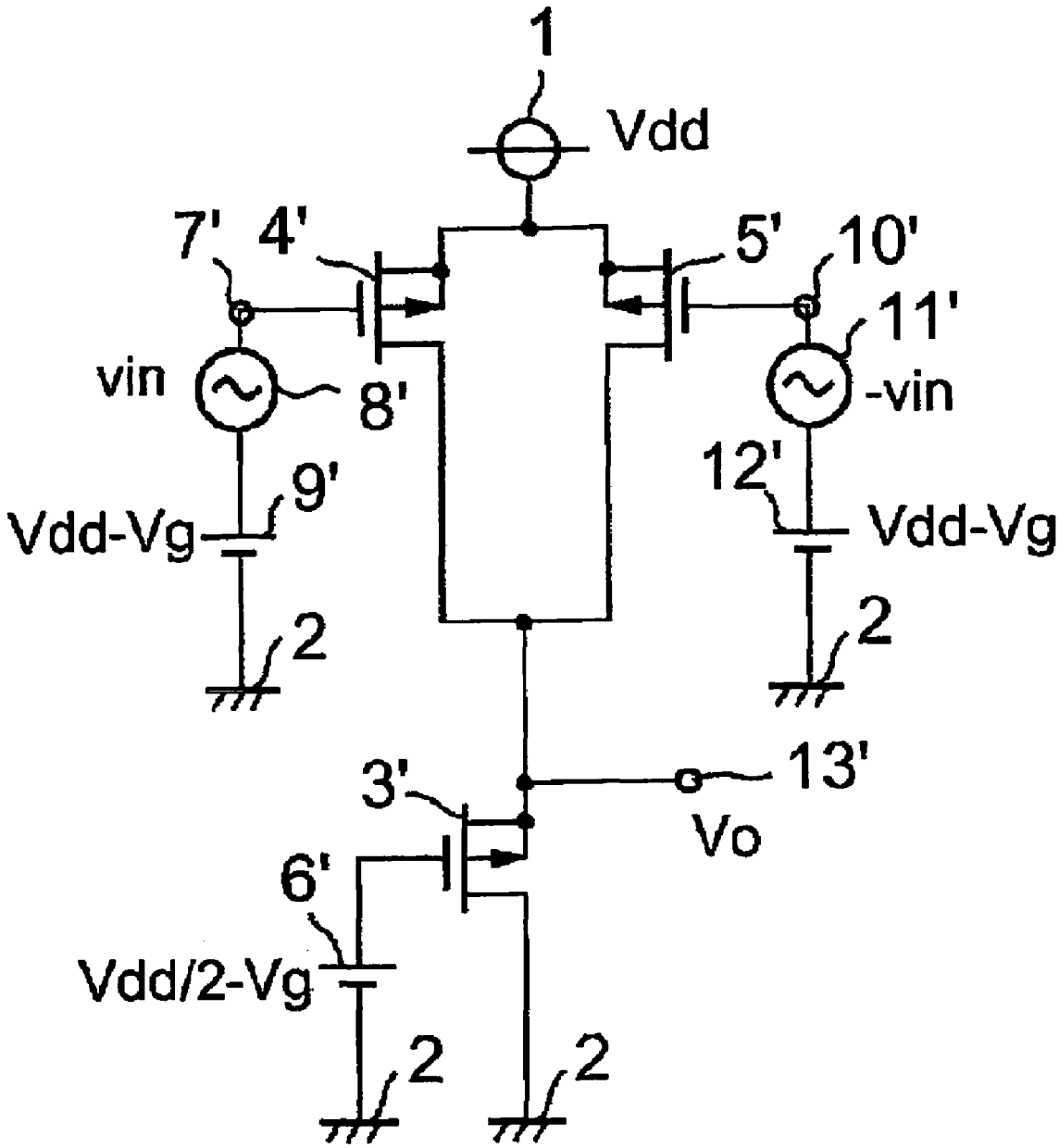
FIG. 3 is a circuit diagram showing a configuration of a modification to the multiplier according to the embodiment 1 of the present invention.

It is to be noted that, while, in the present embodiment 1, only NMOS transistors are used to form a multiplier, a similar multiplier can be formed even if only PMOS transistors are used. FIG. 3 is a circuit diagram showing a configuration of a modification to the multiplier according to the embodiment 1 of the present invention. In FIG. 3, those components which exhibit similar operation to those of the components of multiplier shown in FIG. 2 are denoted by like reference characters with a dash added thereto so as to clearly indicate a corresponding relationship between them. For example, the PMOS transistor 3', PMOS transistor 4' and PMOS transistor 5' are given as components which individually exhibit similar operations to those of the NMOS transistor 3, NMOS transistor 4 and NMOS transistor 5, respectively. Further, similarly as in the multiplier shown in FIG. 2, the PMOS transistor 4' and the PMOS transistor 5' are formed same as each other and the constant voltage source 9' and the constant voltage source 12' have an equal voltage value, and the PMOS transistor 3' has a drain current coefficient equal to twice that of the PMOS transistor 4' and the PMOS transistor 5'. Further, voltage values added to the individual voltage sources indicate voltage values where the bias voltage at the output terminal 13' is set to Vdd/2.

Embodiment 2

Figure 4:
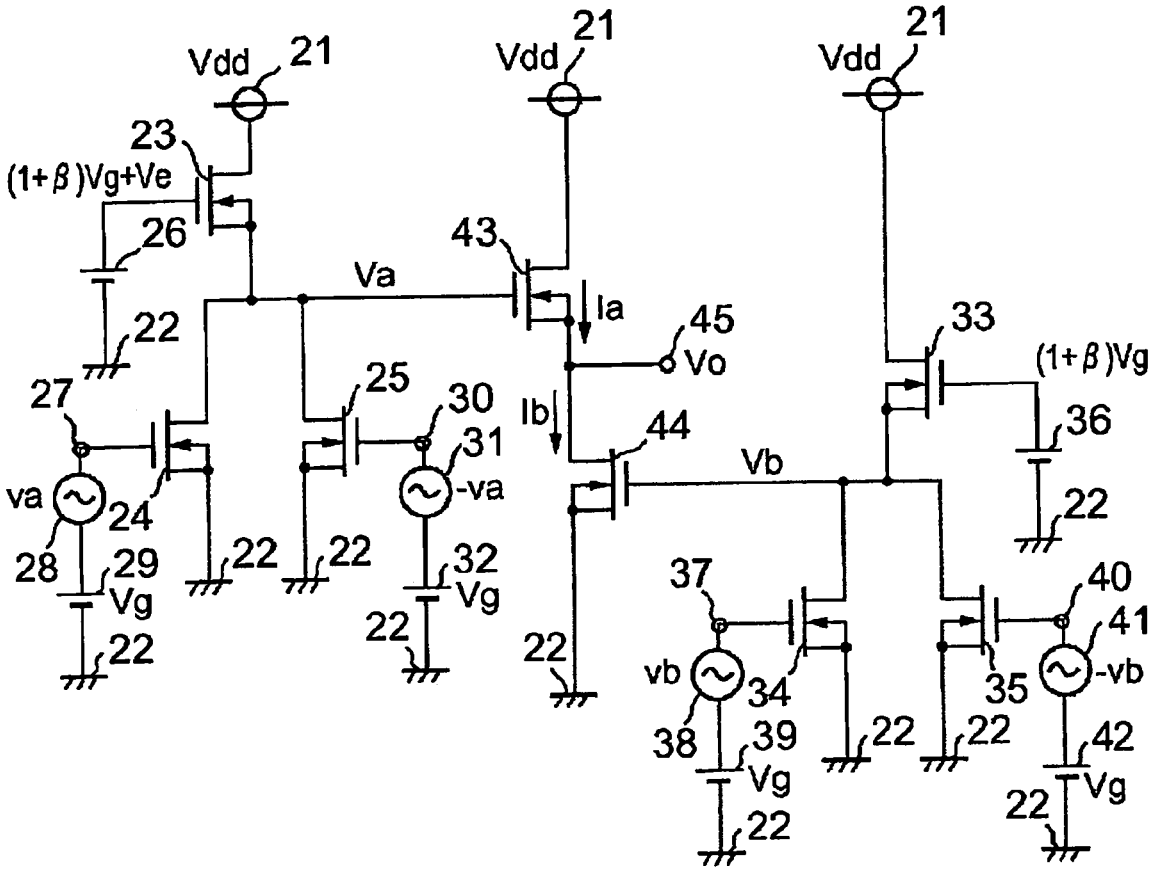
FIG. 4 is a circuit diagram showing a configuration of a multiplier according an embodiment 2 of the present invention.

FIG. 4 is a circuit diagram showing a configuration of a multiplier according to an embodiment 2 of the present invention. Referring to FIG. 4, reference numeral 21 denotes a voltage source, 22 a ground, 23 an NMOS transistor (first MOS transistor) connected at the drain thereof to the voltage source 21, 24 an NMOS transistor (second NMOS transistor) connected at the drain thereof to the source of the NMOS transistor 23 and at the source thereof to the ground 22, and 25 an NMOS transistor (third NMOS transistor) connected at the drain thereof to the source of the NMOS transistor 23 and at the source thereof to the ground 22. Reference numeral 26 denotes a constant voltage source (first voltage source) connected to the gate of the NMOS transistor 23, 27 a first input terminal connected to the gate of the NMOS transistor 24, 28 a first differential signal source for applying an input signal va which is one of two differential signals to the first input terminal 27, 29 a constant voltage source (second voltage source) for applying a predetermined voltage to the first input terminal 27, and 30 a second input terminal connected to the gate of the NMOS transistor 25. Further, reference numeral 31 denotes a second differential signal source for applying the other input signal −va which forms the first differential signals to the second input terminal 30, and 32 a constant voltage source (third voltage source) for applying a predetermined voltage to the second input terminal 30.

Reference numeral 33 denotes an NMOS transistor (fourth NMOS transistor) connected at the drain thereof to the voltage source 21, 34 an NMOS transistor (fifth NMOS transistor) connected at the drain thereof to the NMOS transistor 33 and at the source thereof to the ground 22, and 35 an NMOS transistor (sixth NMOS transistor) connected at the drain thereof to the source of the NMOS transistor 33 and at the source thereof to the ground 22. Reference numeral 36 denotes a constant voltage source (fourth voltage source) connected to the gate of the NMOS transistor 33, 37 a third input terminal connected to the gate of the NMOS transistor 34, 38 a third differential signal source for applying an input signal vb which forms second differential signals to the third input terminal 37, and 39 a constant voltage source (fifth voltage source) for applying a predetermined voltage to the third input terminal 37. Reference numeral 40 denotes a fourth input terminal connected to the gate of the NMOS transistor 35, 41 a fourth differential signal source for applying the other input signal −vb which forms the second differential signals to the fourth input terminal 40, and 42 a constant voltage source (sixth voltage source) for applying a predetermined voltage to the fourth input terminal 40. Reference numeral 43 denotes an NMOS transistor (seventh NMOS transistor) connected at the drain thereof to the voltage source 21 and at the gate thereof to the source of the NMOS transistor 23, 44 an NMOS transistor (eighth NMOS transistor) connected at the drain thereof to the source of the NMOS transistor 43, at the gate thereof to the source of the NMOS transistor 33 and at the source thereof to the ground 22, and 45 an output terminal connected to a node between the source of the NMOS transistor 43 and the drain of the NMOS transistor 44. It is to be noted that the back gate of each of the NMOS transistors 23, 24, 25, 33, 34, 35, 43 and 44 used in the multiplier shown in FIG. 4 is connected to the source of the NMOS transistor in order to make the mutual conductance equal among them. Further, the constant voltage sources 26, 29, 32, 36, 39 and 42 given as biasing voltage sources can be implemented using various methods such as, for example, a method of dividing the power supply voltage of the voltage source 21 by means of resistors.

Further, it is assumed that, in the multiplier shown in FIG. 4, the NMOS transistor 24 and the NMOS transistor 25 are formed same as each other and the NMOS transistor 34 and the NMOS transistor 35 are formed same as each other, and the NMOS transistor 43 and the NMOS transistor 44 are formed same as each other. Further, it is assumed that the constant voltage source 29, constant voltage source 32, constant voltage source 39 and constant voltage source 42 have voltage values equal to one another.

Now, operation is described. Referring to FIG. 4, the drain current coefficients of the NMOS transistor 43 and the NMOS transistor 44 are represented by M, and the mutual conductance of them by gm. Further, the drain current of the NMOS transistor 43 is represented by Ia, and the drain current of the NMOS transistor 44 by Ib. Further, the power supply voltage value of the voltage source 21 is represented by Vdd, the voltage value of the constant voltage source 26 by Vg1, the voltage value of the constant voltage source 36 by Vg2, the voltage values of the constant voltage source 29, constant voltage source 32, constant voltage source 39 and constant voltage source 42 by Vg, the source potential of the NMOS transistor 23 by Va, the source potential of the NMOS transistor 33 by Vb, and the potential of the output terminal 45 by Vo. Further, the difference between the voltage value of the constant voltage source 26 and the voltage value of the constant voltage source 36 is represented by Ve, that is, Vg1=Vg2+Ve. Further, taking the circuit configuration into consideration, the voltage value Vg2 of the constant voltage source 36 is set in such a manner as to be represented by an expression (17). In the expression (17), β is given as a number equal to or higher than 1. Further, based on the expression (17) and setting regarding the potential difference between the constant voltage source 36 and the constant voltage source 26, the voltage value Vg1 of the constant voltage source 26 is represented as indicated by an expression (18).

Since the difference between the voltage value of the constant voltage source 26 and the voltage value of the constant voltage source 29 and the constant voltage source 32 is Ve+β·Vg, the source potential Va of the NMOS transistor 23 is given as indicated by an expression (19) through a calculation process similar to that of the expressions (1) to (10). Further, since the difference between the voltage value of the constant voltage source 36 and the voltage value of the constant voltage source 39 and the constant voltage source 42 is β·Vg, the source potential Vb of the NMOS transistor 33 is given as indicated by an expression (20) through a calculation process similar to that of the expressions (1) to (10). It is to be noted that, in order to obtain the expression (19) and the expression (20), it is presupposed that the conditions of the expression (5) are satisfied, that is, the drain current coefficient of the NMOS transistor 23 is equal to twice the drain current coefficient of the NMOS transistor 24 and the NMOS transistor 25 and the drain current coefficient of the NMOS transistor 33 is equal to twice the drain current coefficient of the NMOS transistor 34 and the NMOS transistor 35.

$$Vg2=(1+\beta)Vg \tag{17}$$

$$Vg1=(1+\beta)Vg+Ve \tag{18}$$

$$Va = Ve + \beta \cdot Vg - \frac{va^2}{2(Vg - Vth)} \tag{19}$$

$$Vb = \beta \cdot Vg - \frac{vb^2}{2(Vg - Vth)} \tag{20}$$

If it is assumed that the output terminal 45 is in an open state or is in a state proximate to an open state, then the drain currents Ia and Ib satisfy a condition of Ia=Ib. The drain current Ia is given by an expression (21), and the drain current Ib is given by another expression (22). Accordingly, by substituting the expressions (21) and (22) into Ia=Ib, Vo=Va−Vb is obtained, and the potential Vo of the output terminal 45 is given as indicated by an expression (23). As clearly recognized from the expression (23), the bias voltage at the output terminal 45 becomes equal to the voltage difference Ve between the voltage value of the constant voltage source 26 and the voltage value of the constant voltage source 36. Accordingly, if the voltage difference Ve is set so as to be equal to one half the power supply voltage value Vdd, then the bias voltage at the outputting section of the multiplier can be made equal to Vdd/2, and the greatest dynamic range can be obtained.

$$Ia = \frac{M}{2}(Va - Vo - Vth)^2 = \frac{gm}{2} \cdot (Va - Vo - Vth) \tag{21}$$

$$Ib = \frac{M}{2}(Vb - Vth)^2 = \frac{gm}{2}(Vb - Vth) \tag{22}$$

$$Vo = Va - Vb = Ve - \frac{va^2 - vb^2}{2 \cdot (Vg - Vth)} \tag{23}$$

As indicated by the expression (23), it can be recognized that a voltage signal which increases in proportion to the difference between the square of the first input signal va and the square of the second input signal vb is outputted from the outputting section. Here, if the first input signal va is given as the sum of the two signals having different frequencies from each other as indicated by an expression (24) and the second input signal vb is given as the difference of the two signals having the different frequencies from each other as indicated by an expression (25), then the difference between the square of the first input signal va and the square of the second input signal vb is introduced as indicated by an expression (26). Then, if it is assumed that an LPF is used to remove high frequency band components from the output signal, then the potential Vo at the output terminal 45 is given as indicated by an expression (27). The second term of the right side of the expression (27) indicates frequency conversion regarding the two signals of different frequencies which form the first input signal va and the second input signal vb.

$$va=A \sin \omega_1 t+B \sin \omega_2 t \tag{24}$$

$$vb=A \sin \omega_1 t-B \sin \omega_2 t \tag{25}$$

$$\begin{aligned} va^2 - vb^2 &= A^2\sin^2\omega_1 t + 2AB\sin\omega_1 t\sin\omega_2 t + B^2\sin^2\omega_2 t - \\ &\quad A^2\sin^2\omega_1 t + 2AB\sin\omega_1 t\sin\omega_2 t - B^2\sin^2\omega_2 t \\ &= 4AB\sin\omega_1 t\sin\omega_2 t \\ &= 2AB\cos(\omega_1 - \omega_2)t - 2AB\cos(\omega_1 + \omega_2)t \end{aligned} \tag{26}$$

$$Vo = Va - Vb = Ve - \frac{AB\cos(\omega_1 - \omega_2)t}{Vg - Vth} \tag{27}$$

Further, if it is assumed that the first input signal va is given as the sum of two signals which are equal to each other in frequency but are different from each other only in phase and the second input signal vb is given as the difference between the two signals which are equal to each other in frequency but are different from each other only in phase, then the potential Vo of the output terminal 45 is given as indicated by an expression (28) through a calculation procedure similar to that described hereinabove. The second term of the right side of the expression (28) indicates phase detection regarding the two signals which form the first input signal va and the second input signal vb and are equal in frequency but different only in phase.

$$Vo = Ve - \frac{AB\cos\{\omega_1 t - (\omega_1 t + \theta)\}}{Vg - Vth} = Ve - \frac{AB\cos\theta}{Vg - Vth} \tag{28}$$

As described hereinabove, it can be recognized that, since it is indicated by the expression (23) that an output signal which increases in proportion to $va^2 - vb^2$ is obtained in response to the first input signal va and the second input signal vb and a characteristic that frequency conversion of the two signals which form the input signals va and vb is indicated by the expression (27) while a characteristic that phase detection of the two signals which form the input signals va and vb is indicated by the expression (28), the circuit shown in FIG. 4 has a function as a mixer. Further, as clear from the expressions (27) and (28), with the multiplier shown in FIG. 4, a DC offset which arises from AC components can be removed by the outputting section. Furthermore, in the multiplier shown in FIG. 4, since all of the MOS transistors used have a single channel configuration given as NMOS transistors, errors arising from the production dispersions cancel each other to suppress variations in bias voltage and AC components to stabilize the circuit operation.

As described above, according the present embodiment 2, the multiplier includes NMOS transistors 23, 24, 25, 33, 34, 35, 43 and 44 and constant voltage sources 26, 29, 32, 36, 39 and 42, connected to the gates of the NMOS transistors 23, 24, 25, 33, 34, 35, respectively. Further, the constant current sources 29, 32, 39 and 42 have voltage values equal to one another. Furthermore, the NMOS transistor 24 and the NMOS transistor 25 are formed same as each other and the NMOS transistor 34 and the NMOS transistor 35 are formed same as each other while the NMOS transistor 43 and the NMOS transistor 44 are formed same as each other. Consequently, when first differential signals are inputted to the gates of the NMOS transistor 24 and the NMOS transistor 25 and second differential signals are inputted to the gates of the NMOS transistor 34 and the NMOS transistor 35, the circuit of the embodiment 2 operates as a multiplier and exhibits an effect that the circuit operation can be stabilized and the power consumption can be reduced even with a simple configuration. Further, the circuit of the embodiment 2 exhibits another effect that a DC offset which arises from AC components can be reduced by an outputting section of the multiplier. Furthermore, since there is no necessity to add a current mirror or the like in order to obtain a voltage output, the circuit of the embodiment 2 exhibits an effect that a good frequency characteristic can be obtained. It is to be noted that, while, in the present embodiment 2, the NMOS transistor 24 and the NMOS transistor 25, the NMOS transistor 34 and the NMOS transistor 35, and the NMOS transistor 43 and the NMOS transistor 44 are individually formed same as each other, a multiplier which exhibits the effects described above can be obtained by forming them such that they have an equal drain current coefficient to each other similarly as in the embodiment 1.

Further, the NMOS transistor 23, NMOS transistor 24 and NMOS transistor 25 are formed such that the NMOS transistor 23 has a drain current coefficient equal to twice the drain current coefficient of the NMOS transistor 24 and the NMOS transistor 25 and the NMOS transistor 33, NMOS transistor 34 and NMOS transistor 35 are formed such that the NMOS transistor 33 has a drain current coefficient equal to twice the drain current coefficient of the NMOS transistor 34 and the NMOS transistor 35. Furthermore, the voltage difference between the voltage value of the constant voltage source 26 and the voltage value of the constant voltage source 36 is set so as to be equal to Vdd/2 which is a voltage value equal one half the power supply voltage value. Consequently, the bias voltage at the outputting section can be set to Vdd/2, and an effect that a large dynamic range can be obtained is exhibited.

Figure 5:
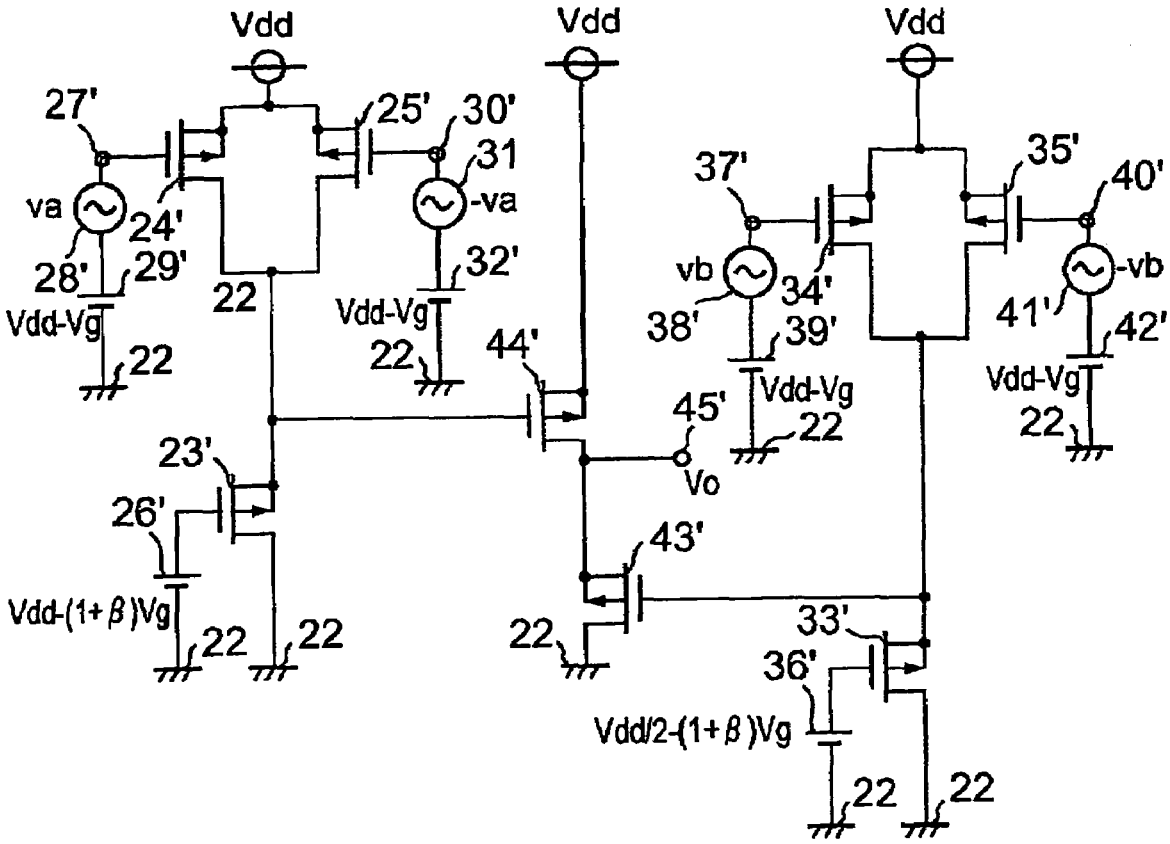
FIG. 5 is a circuit diagram showing a configuration of a modification to the multiplier according to the embodiment 2 of the present invention.

It is to be noted that, while, in the present embodiment 2, only NMOS transistors are used to form a multiplier, a similar multiplier can be formed even if only PMOS transistors are used. FIG. 5 is a circuit diagram showing a configuration of a modification to the multiplier according to the embodiment 2 of the present invention. In FIG. 5, those components which exhibit similar operation to those of the components of multiplier shown in FIG. 4 are denoted by like reference characters with a dash added thereto so as to clearly indicate a corresponding relationship between them. For example, the PMOS transistor 23', PMOS transistor 24' and PMOS transistor 25' are given as components which individually exhibit similar operations to those of the NMOS transistor 23, NMOS transistor 24 and NMOS transistor 25, respectively. Further, similarly as in the multiplier shown in FIG. 4, the constant voltage source 29', constant voltage source 32', constant voltage source 39' and constant voltage source 42' have an equal voltage value. Further, the PMOS transistor 24' and the PMOS transistor 25' are formed same as each other, and the PMOS transistor 23' is formed so as to have a drain current coefficient equal to twice the drain current coefficient of the PMOS transistor 24' and the PMOS transistor 25'. Furthermore, the PMOS transistor 34' and the PMOS transistor 35' are formed same as each other, and the PMOS transistor 33' is formed so as to have a drain current coefficient equal to twice the drain current coefficient of the PMOS transistor 34' and the PMOS transistor 35'. Further, the PMOS transistor 43' and the PMOS transistor 44' are formed same as each other. It is to be noted that voltage values added to the individual constant voltage sources indicate voltage values where the bias voltage at the output terminal 45' is set to Vdd2.

Embodiment 3

Figure 6:
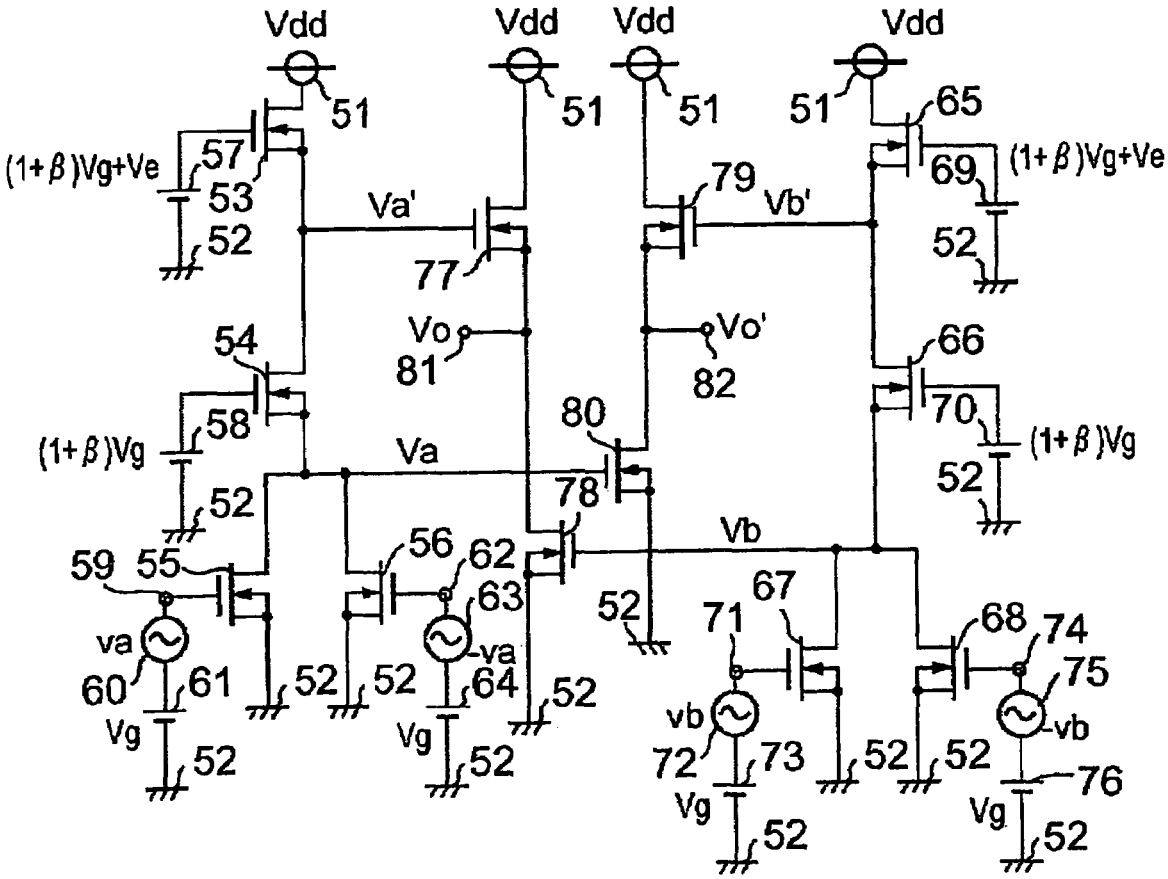
FIG. 6 is a circuit diagram showing a configuration of a multiplier according an embodiment 3 of the present invention.

FIG. 6 is a circuit diagram showing a configuration of a multiplier according to an embodiment 3 of the present invention. Referring to FIG. 6, reference numeral 51 denotes a voltage source, 52 a ground, 53 an NMOS transistor (first MOS transistor) connected at the drain thereof to the voltage source 51, 54 an NMOS transistor (second MOS transistor) connected at the drain thereof to the source of the NMOS transistor 53, 55 an NMOS transistor (third MOS transistor) connected at the drain thereof to the source of the NMOS transistor 54, and 56 an NMOS transistor (fourth MOS transistor) connected at the drain thereof to the source of the NMOS transistor 54. Reference numeral 57 denotes a constant voltage source (first voltage source) connected to the gate of the NMOS transistor 53, 58 a constant voltage source (second voltage source) connected to the gate of the NMOS transistor 54, 59 a first input terminal connected to the gate of the NMOS transistor 55, 60 a first differential signal source for applying an input signal va which is one of two differential signals to the first input terminal 59, 61 a constant voltage source (third voltage source) for applying a predetermined voltage to the first input terminal 59, and 62 a second input terminal connected to the gate of the NMOS transistor 56. Further, reference numeral 63 denotes a second differential signal source for applying the other input signal −va which forms the first differential signals to the second input terminal 62, and 64 a constant voltage source (fourth voltage source) for applying a predetermined voltage to the second input terminal 62.

Reference numeral 65 denotes an NMOS transistor (fifth MOS transistor) connected at the drain thereof to the voltage source 51, 66 an NMOS transistor (sixth NMOS transistor) connected at the drain thereof to the source of the NMOS transistor 65, 67 an NMOS transistor (seventh MOS transistor) connected at the drain thereof to the source of the NMOS transistor 66, and 68 an NMOS transistor (eighth MOS transistor) connected at the drain thereof to the source of the NMOS transistor 66. Reference numeral 69 denotes a constant voltage source (fifth voltage source) connected to the gate of the NMOS transistor 65, 70 a constant voltage source (sixth voltage source) connected to the gate of the NMOS transistor 66, 71 a third input terminal connected to the gate of the NMOS transistor 67, 72 a third differential signal source for applying an input signal vb which forms second differential signals to the third input terminal 71, and 73 a constant voltage source (seventh voltage source) for applying a predetermined voltage to the third input terminal 71. Reference numeral 74 denotes a fourth input terminal connected to the gate of the NMOS transistor 68, 75 a fourth differential signal for applying the other input signal −vb which forms the second differential signals to the fourth input terminal 74, and 76 a constant voltage source (eighth voltage source) for applying a predetermined voltage to the fourth input terminal 74.

Reference numeral 77 denotes an NMOS transistor (ninth MOS transistor) connected at the drain thereof to the voltage source 51 and at the gate thereof to the source of the NMOS transistor 53, 78 an NMOS transistor (tenth MOS transistor) connected at the drain thereof to the source of the NMOS transistor 77, at the gate thereof to the source of the NMOS transistor 66 and at the source thereof to the ground 52, and 79 an NMOS transistor (eleventh MOS transistor) connected at the drain thereof to the voltage source 51 and at the gate thereof to the source of the NMOS transistor 65. Reference numeral 80 denotes an NMOS transistor (twelfth MOS transistor) connected at the drain thereof to the source of the NMOS transistor 79, at the gate thereof to the source of the NMOS transistor 54 and at the source thereof to the ground 52, 81 a first output terminal connected to a node between the source of the NMOS transistor 77 and the drain of the NMOS transistor 78, and 82 a second output terminal connected to a node between the source of the NMOS transistor 79 and the drain of the NMOS transistor 80. It is to be noted that the back gate of each of the NMOS transistors 53, 54, 55, 56, 65, 66, 67, 78, 77, 78, 79 and 80 used in the multiplier shown in FIG. 6 is connected to the source of the transistor. Further, the constant voltage sources 57, 58, 61, 64, 69, 70, 73 and 76 given as biasing voltage sources can be implemented using various methods such as, for example, a method of dividing the power supply voltage of the voltage source 51 by means of resistors.

Further, it is assumed that, in the multiplier shown in FIG. 6, the NMOS transistor 55 and the NMOS transistor 56 are formed same as each other and the NMOS transistor 67 and the NMOS transistor 68 are formed same as each other, and the NMOS transistor 77 and the NMOS transistor 78 are formed same as each other and the NMOS transistor 79 and the NMOS transistor 80 are formed same as each other. Further, it is assumed that the constant voltage source 57 and the constant voltage source 69 have voltage values equal to each other and the constant voltage source 58 and the constant voltage source 70 have voltage values equal to each other, and the constant voltage source 61, constant voltage source 64, constant voltage source 73 and constant voltage source 76 have voltage values equal to one another.

Now, operation is described. Referring to FIG. 6, the voltage value of the constant voltage source 57 and the constant voltage source 69 is represented by Vg1, the voltage value of the constant voltage source 58 and the constant voltage source 70 by Vg2, voltage values of the constant voltage source 61, constant voltage source 64, constant voltage source 73 and constant voltage source 76 by Vg, the source potential of the NMOS transistor 54 by Va, the source potential of the NMOS transistor 53 by Va', the source potential of the NMOS transistor 66 by Vb, the source potential of the NMOS transistor 65 by Vb', the potential of the output terminal 81 by Vo, and the potential of the output terminal 82 by Vo'. Further, the difference between the voltage value of the constant voltage source 57 and the constant voltage source 69 and the voltage value of the constant voltage source 58 and the constant voltage source 70 is represented by Ve, that is, Vg1=Vg2+Ve. Further, taking the circuit configuration into consideration, the voltage value Vg2 of the constant voltage source 58 and the constant voltage source 70 is set in such a manner as to be represented by an expression (29). In the expression (29), β is given as a number equal to or higher than 1. Further, based on the expression (29) and setting regarding the potential difference between the constant voltage source 58 and constant voltage source 70 and the constant voltage source 57 and constant voltage source 69, the voltage value Vg1 of the constant voltage source 57 and the constant voltage source 69 is given as indicated by an expression (30).

$$Vg2=(1+\beta)Vg \tag{29}$$

$$Vg1=Ve+(1+\beta)Vg \tag{30}$$

Since the difference between the voltage value of the constant voltage source 58 and the voltage value of the constant voltage source 61 and the constant voltage source 64 is β·Vg, the source potential Va of the NMOS transistor 54 is given as indicated by an expression (31) through a calculation process similar to that of the expressions (1) to (10). Similarly, since the difference between the voltage value of the constant voltage source 70 and the voltage value of the constant voltage source 73 and the constant voltage source 76 is β·Vg, the source potential Vb of the NMOS transistor 66 is given as indicated by an expression (32). Further, since the difference between the voltage value of the constant voltage source 57 and the voltage value of the constant voltage source 61 and the constant voltage source 64 is Ve+β·Vg, the source potential Va' of the NMOS transistor 53 is given as indicated by an expression (33) through a calculation process similar to that of the expressions (1) to (10). Similarly, since the difference between the voltage value of the constant voltage source 69 and the voltage value of the constant voltage source 73 and the constant voltage source 76 is Ve+β·Vg, the source potential Vb' of the NMOS transistor 65 is given as indicated by an expression (34). Here, in order to obtain the expressions (31), (32), (33) and (34), it is presupposed that the conditions of the expression (5) are satisfied, that is, the drain current coefficient of the NMOS transistor 53 and the NMOS transistor 54 is equal to twice the drain current coefficient of the NMOS transistor 55 and the NMOS transistor 56 and the drain current coefficient of the NMOS transistor 65 and the NMOS transistor 66 is equal to twice the drain current coefficient of the NMOS transistor 67 and the NMOS transistor 68.

$$Va = \beta \cdot Vg - \frac{va^2}{2(Vg - Vth)} \tag{31}$$

$$Vb = \beta \cdot Vg - \frac{vb^2}{2(Vg - Vth)} \tag{32}$$

$$Va' = Ve + \beta \cdot Vg - \frac{va^2}{2(Vg - Vth)} \tag{33}$$

$$Vb' = Ve + \beta \cdot Vg - \frac{vb^2}{2(Vg - Vth)} \tag{34}$$

If it is assumed that the output terminal 81 is in an open state or is in a state proximate to an open state, then the potential Vo of the output terminal 81 is given as indicated by an expression (35) through a calculation process similar to that of the expressions (21) and (22). Further, if it is assumed that the output terminal 82 is in an open state or is in a state proximate to an open state, then Vo'=Vb'−Va is obtained through a calculation process similar to that of the expressions (21) and (22), and the potential Vo' of the output terminal 82 is given as indicated by an expression (36). As clearly recognized from the expressions (35) and (36), the bias voltages at the output terminal 81 and the output terminal 82 are equal to the voltage difference Ve between the voltage value of the constant voltage source 57 and constant voltage source 69 and the voltage value of the constant voltage source 58 and the constant voltage source 70. Accordingly, if the voltage difference Ve is set so as to be equal to one half the power supply voltage value Vdd, then the bias voltage at the outputting section of the multiplier can be made equal to Vdd/2, and the greatest dynamic range can be obtained.

$$Vo = Va' - Vb = \frac{Vdd}{2} - \frac{va^2 - vb^2}{2(Vg - Vth)} \tag{35}$$

$$Vo' = Vb' - Va = \frac{Vdd}{2} - \frac{vb^2 - va^2}{2(Vg - Vth)} \tag{36}$$

As indicated by the expressions (35) and (36), it can be recognized that a voltage signal which increases in proportion to the difference between the square of the first input signal va and the square of the second input signal vb is obtained as a differential output in output terminal 81 and output terminal 82. Further, it can be recognized that, by analyzing the expressions (35) and (36) similarly as in the analysis of the expression (23) performed using the expressions (25) to (28), the multiplier shown in FIG. 6 has a characteristic that it can perform frequency conversion and phase detection of two signals which form the input signals va and vb and has a function as a mixer. Furthermore, also in the present embodiment 3, since expressions similar to the expressions (27) and (28) can be obtained regarding AC components of an output signal, a DC offset which is caused by the AC components can be removed by the outputting section. Further, since the multiplier shown in FIG. 6 has a single channel configuration wherein all of the MOS transistors used are given as NMOS transistors, errors arising from production dispersions cancel each other, and variations of bias voltages and AC components can be suppressed to stabilize the circuit operation.

As described above, according the present embodiment 3, the multiplier includes NMOS transistors 53, 54, 55, 56, 65, 66, 67, 68, 77, 78, 79 and 80 and constant voltage sources 57, 58, 61, 64, 69, 70, 73 and 76 connected to the gates of the NMOS transistors 53, 54, 55, 56, 65, 66, 67 and 68, respectively. Further, the constant voltage sources 61, 64, 73 and 76 have voltage values equal to one another. Furthermore, the NMOS transistor 55 and the NMOS transistor 56 are formed same as each other and the NMOS transistor 67 and the NMOS transistor 68 are formed same as each other while the NMOS transistor 77 and the NMOS transistor 78 are formed same as each other and the NMOS transistor 79 and the NMOS transistor 80 are formed same as each other. Consequently, when first differential signals are inputted to the gates of the NMOS transistor 55 and the NMOS transistor 56 and second differential signals are inputted to the gates of the NMOS transistor 67 and the NMOS transistor 68, the circuit of the embodiment 3 operates as a multiplier and exhibits an effect that the circuit operation can be stabilized and the power consumption can be reduced even with a simple configuration. Further, the circuit of the embodiment 3 exhibits another effect that an output of the multiplier can be obtained as differential signals and a DC offset which arises from AC components can be removed by an outputting section of the multiplier. Furthermore, since there is no necessity to add a current mirror or the like in order to obtain a voltage output, the circuit of the embodiment 3 exhibits an effect that a good frequency characteristic can be obtained. It is to be noted that, while, in the present embodiment 3, the NMOS transistor 55 and the NMOS transistor 56, the NMOS transistor 67 and the NMOS transistor 68, the NMOS transistor 77 and the NMOS transistor 78, and the NMOS transistor 79 and the NMOS transistor 80 are formed same as each other, a multiplier which exhibits the effects described above can be obtained by forming them such that they have an equal drain current coefficient to each other similarly as in the embodiment 1.

Further, the NMOS transistor 53, NMOS transistor 54, NMOS transistor 55 and NMOS transistor 56 are formed such that the NMOS transistor 53 and the NMOS transistor 54 have a drain current coefficient equal to twice the drain current coefficient of the NMOS transistor 55 and the NMOS transistor 56 and the NMOS transistor 65, NMOS transistor 66, NMOS transistor 67 and NMOS transistor 68 are formed such that the NMOS transistor 65 and the NMOS transistor 66 have a drain current coefficient equal to twice the drain current coefficient of the NMOS transistor 67 and the NMOS transistor 68. Furthermore, the constant voltage source 57 and the constant voltage source 69 have an equal voltage value and the constant voltage source 58 and the constant voltage source 70 have an equal voltage value, and the voltage difference between the voltage value of the constant voltage source 57 and the constant voltage source 69 and the voltage value of the constant voltage source 58 and the constant voltage source 70 is equal to Vdd/2 which is a voltage value equal one half the power supply voltage value of the power supply voltage 51. Consequently, the bias voltage at the outputting section can be set to Vdd/2, and an effect that a large dynamic range can be obtained is exhibited.

Figure 7:
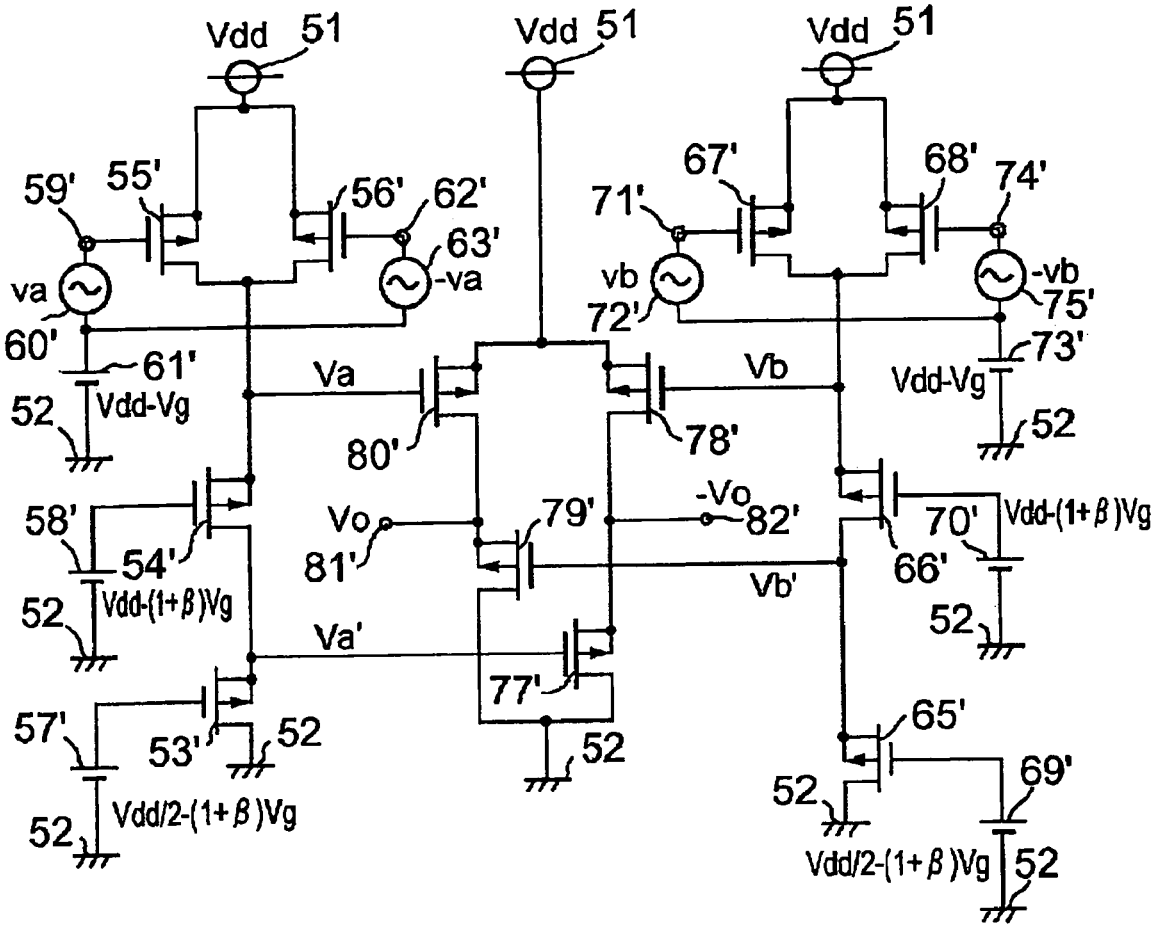
FIG. 7 is a circuit diagram showing a configuration of a modification to the multiplier according to the embodiment 3 of the present invention.

It is to be noted that, while, in the present embodiment 3, only NMOS transistors are used to form a multiplier, a similar multiplier can be formed even if only PMOS transistors are used. FIG. 7 is a circuit diagram showing a configuration of a modification to the multiplier according to the embodiment 3 of the present invention. In FIG. 7, those components which exhibit similar operation to those of the components of multiplier shown in FIG. 6 are denoted by like reference characters with a dash added thereto so as to clearly indicate a corresponding relationship between them. For example, the PMOS transistor 53', PMOS transistor 54', PMOS transistor 55', and PMOS transistor 56' are given as components which individually exhibit similar operations to those of the NMOS transistor 53, NMOS transistor 54, NMOS transistor 55 and NMOS transistor 56, respectively. Further, similarly as in the multiplier shown in FIG. 6, the constant voltage source 61' and the constant voltage source 73' have an equal voltage value and the constant voltage source 57' and the constant voltage source 69' have an equal voltage value while the constant voltage source 58' and the constant voltage source 70' have an equal voltage value. Further, the PMOS transistor 55' and the PMOS transistor 56' are formed same as each other, and the PMOS transistor 53' and the PMOS transistor 54' are formed so as to have a drain current coefficient equal to twice the drain current coefficient of the PMOS transistors 55' and 56'. Furthermore, the PMOS transistor 67' and the PMOS transistor 68' are formed same as each other, and the PMOS transistor 65' and the PMOS transistor 66' are formed so as to have a drain current coefficient equal to twice the drain current coefficient of the PMOS transistors 67' and 68'. Further, the PMOS transistor 77' and the PMOS transistor 78' are formed same as each other, and the PMOS transistor 79' and the PMOS transistor 80' are formed same as each other. It is to be noted that voltage values added to the individual constant voltage sources indicate voltage values where the bias voltages at the output terminal 81' and the output terminal 82' are set to Vdd/2.

It is to be noted that the multipliers described in connection with the embodiments 1 to 3 above do not restrict the invention of the present application but are disclosed intending that they are only illustrative. The technical scope of the invention of the present application should be defined by the claims, and various design alterations are possible within the technical scope described in the claims.

INDUSTRIAL APPLICABILITY

As described above, with the multiplier according to the present invention, circuit operation can be stabilized and power consumption can be reduced even with a simple configuration. Further, since there is no necessity to add a current mirror or the like in order to obtain a voltage output, a good frequency characteristic can be obtained. Further, a DC offset which arises from AC components can be removed by the outputting section of the multiplier.

Furthermore, the bias voltage at the outputting section can be set to a voltage value equal to substantially one half the power supply voltage, and a great dynamic range can be obtained.

The invention claimed is:

1. A multiplier comprising:

a first MOS transistor, a second MOS transistor having a drain connected to a source of said first MOS transistor, and a third MOS transistor having a drain connected to the source of said first MOS transistor;

a first voltage source connected to a gate of said first MOS transistor, a second voltage source connected to a gate of said second MOS transistor, and a third voltage source connected to a gate of said third MOS transistor; and said second MOS transistor and said third MOS transistor are formed in such a manner as to have drain current coefficients substantially equal to each other and said second voltage source and said third voltage source have voltage values substantially equal to each other while all of said first to third MOS transistors are given either as NNOS transistors or as PMOS transistors, wherein an output terminal of the multiplier is provided at one of the source of the first MOS transistor, the drain of the second MOS transistor, and the drain of the third MOS transistor.

2. A multiplier according to claim 1, wherein said first MOS transistor is formed in such a manner as to have a drain current coefficient substantially equal to twice a drain current coefficient of said second MOS transistor and said third MOS transistor, and a voltage difference between the voltage value of said first voltage source and the voltage value of said second voltage source and said third voltage source is substantially equal to one half a power supply voltage value.

* * * * *

UNITED STATES PATENT AND TRADEMARK OFFICE

CERTIFICATE OF CORRECTION

PATENT NO. : 7,321,253 B2
APPLICATION NO. : 10/499867
DATED : January 22, 2008
INVENTOR(S) : Atsushi Hirabayashi and Kenji Komori It is certified that error appears in the above-identified patent and that said Letters Patent is hereby corrected as shown below:

On the Title Pg Item (54) & Col. 1 line (1), Title, "MULTIPLIER" should read --MULTIPLIER FORMED USING MOS TRANSISTORS--;

Column 20, line 44, "NNOS" should read --NMOS--.

Signed and Sealed this

Tenth Day of March, 2009

JOHN DOLL
*Acting Director of the United States Patent and Trademark Office*